US012600447B2

(12) United States Patent
Suzuki

(10) Patent No.: US 12,600,447 B2
(45) Date of Patent: Apr. 14, 2026

(54) ENVIRONMENT RECOGNITION SYSTEM

(71) Applicant: HONDA MOTOR CO., LTD., Tokyo (JP)

(72) Inventor: Ryuta Suzuki, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 94 days.

(21) Appl. No.: 18/617,215

(22) Filed: Mar. 26, 2024

(65) Prior Publication Data

US 2025/0304224 A1 Oct. 2, 2025

(51) Int. Cl.

| | |
|---|---|
| ***B63B 79/00*** | (2020.01) |
| ***B63B 49/00*** | (2006.01) |
| ***B63B 79/15*** | (2020.01) |
| ***B63H 25/04*** | (2006.01) |

(52) U.S. Cl.

CPC ..... *B63B 79/15* (2020.01); *B63B 49/00* (2013.01); *B63H 25/04* (2013.01); *B63B 2213/00* (2013.01)

(58) Field of Classification Search

CPC ..... B63B 79/15; B63B 49/00; B63B 2213/00; B63H 25/04

USPC ..... 701/21

See application file for complete search history.

(56) References Cited

U.S. PATENT DOCUMENTS

| | | | | |
|---|---|---|---|---|
| 4,071,845 | A | 1/1978 | Gross | |
| 2021/0347449 | A1 | 11/2021 | Dake et al. | |
| 2022/0276357 | A1 | 9/2022 | Lee et al. | |
| 2023/0162395 | A1 * | 5/2023 | Houshiar | G06T 7/75 382/100 |
| 2025/0128798 | A1 * | 4/2025 | Kiji | G05D 1/0206 |

FOREIGN PATENT DOCUMENTS

| | | | | |
|---|---|---|---|---|
| EP | 4016123 | A1 * | 6/2022 | G01S 17/89 |
| KR | 102069100 | B1 | 1/2020 | |

OTHER PUBLICATIONS

Extended European Search Report for European Patent Application No. 25156970.3 dated Jul. 7, 2025; 8 pp.

* cited by examiner

*Primary Examiner* — Tiffany P Young

(74) *Attorney, Agent, or Firm* — Armstrong Teasdale LLP

(57) ABSTRACT

An environment recognition system for watercraft emits a laser beam and receives the laser beam reflected by an object, sets a first distance from the environment recognition system according to a distance from the environment recognition system to a target spot, sets a threshold value regarding intensity of the received laser beam, sets the threshold value higher for the object within the first distance than the object beyond the first distance, eliminates a signal indicating the intensity of the received laser beam lower than the threshold value and identifies a position of the watercraft on a map, and decreases the first distance as the distance from the environment recognition system to the target spot decreases.

10 Claims, 10 Drawing Sheets

10
11
12
camera
13
LiDAR
14
GNSS
15
IMU
16
recognition unit
17
positioning unit
18
input unit
19
notificaton unit
21
main controller
21a
threshold process circuit
20
routing unit
22
tracking unit
23
actuator controller
24
steering actuator
25
shift actuator
26
throttle actuator

ENVIRONMENT RECOGNITION SYSTEM

The present disclosure broadly relates to an automatic berthing system, and in particular to an environment recognition system suitable, not exclusively, for use in an automatic berthing system.

BACKGROUND ART

In recent years, there have been active efforts to provide access to sustainable transportation systems that consider vulnerable people that can be found among transportation participants. For example, in order to further improve the safety and convenience of transportation means, research and development efforts have been directed to automatic piloting of various forms of watercraft and environment recognition for such purposes.

US2021/0347449A1 discloses an automatic docking device that pilots a ship to a designated docking spot by using an environment recognition system. To pilot the ship to the designated docking spot, a lidar system is employed for avoiding obstacles and navigating the ship to the designated docking spot. However, the body of water such as a lake and an ocean surrounding the boat contains various forms of optical noises such as waves, ripples and splashes of water. Such optical noises may be confused with actual obstacles when no measure is taken, but should be filtered out as objects which do not prevent the ship to go through without any problem. Thus, it is a challenge for the environment recognition system to correctly detect objects such as breakwaters, structures and other watercraft without being hampered by such noises. The optical noises may be eliminated by a suitable threshold value process or a filtering process, but it may reduce the resolution power for environment recognition to such an extent that the automatic docking device may not be able to pilot the boat in a reliable manner. Copending U.S. patent application Ser. No. 18/491,947 filed Oct. 23, 2023 and assigned to the common assignee also discloses an automatic berthing system that uses environment recognition for piloting watercraft to an unoccupied berthing space. The contents of these patent documents are incorporated in this application by reference.

In view of such a problem of the prior art, a primary object of the present invention is to provide an environment recognition system that allows surrounding objects to be detected in a reliable manner without being hampered by noises in environmental recognition. Another object of the present invention is to provide an automatic berthing system that allows watercraft to navigate to a selected berthing space in a reliable manner.

DESCRIPTION OF THE PREFERRED EMBODIMENT(S)

Figure 1:
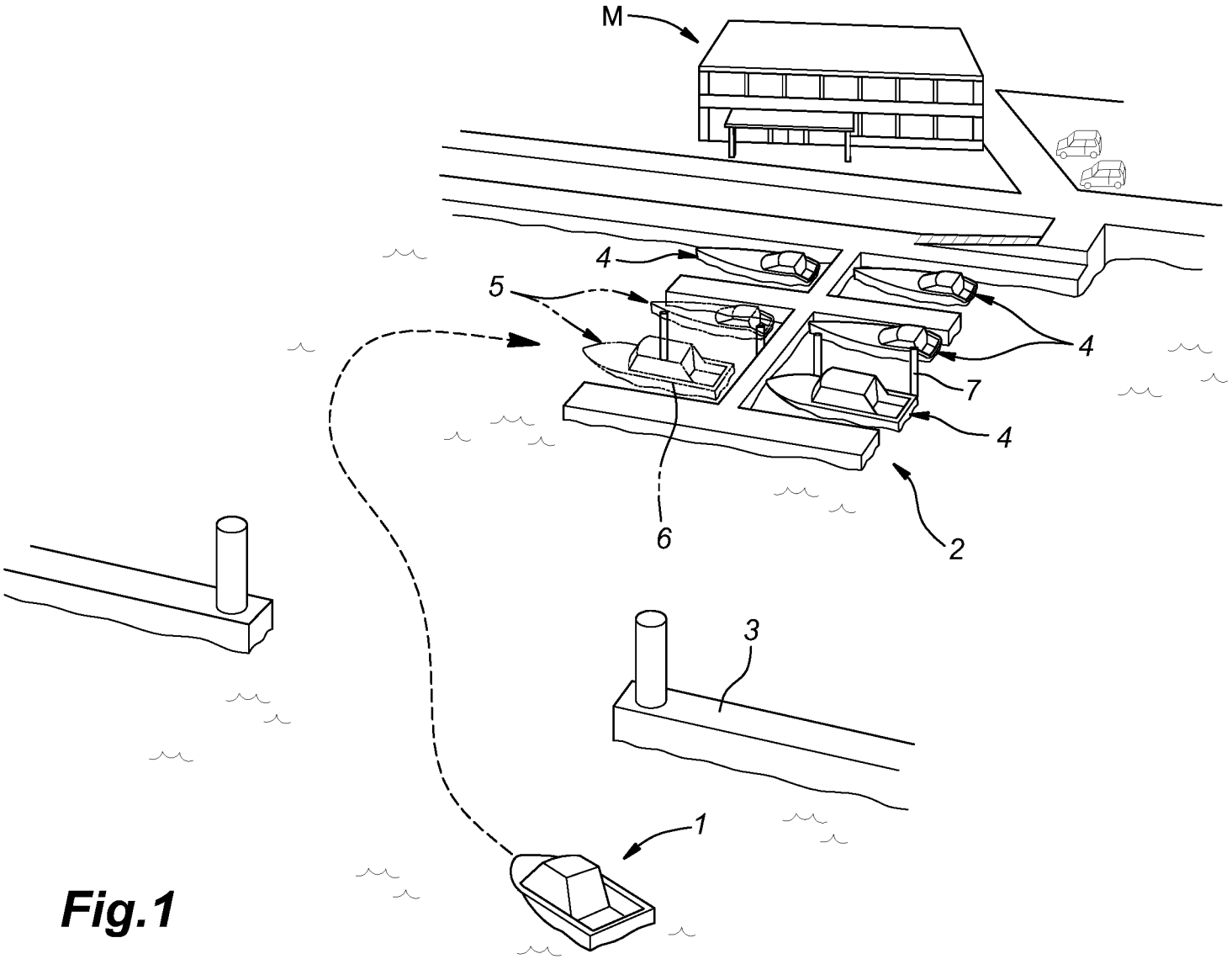
FIG. 1 is a perspective view of a boat navigating toward a berthing space in a mooring facility of a marina.

FIG. 1 shows watercraft in the form of a boat 1 approaching a marina M. The boat 1 is equipped with a propulsion device and a steering device in a per se known manner. The marina M is equipped with a pier 2 that provides a plurality of berthing spaces 4, 5. Some of the berthing spaces 4 are occupied, and other berthing spaces 5 are vacant. The boat 1 is equipped with an automatic navigation system which includes an automatic berthing system 10 (FIG. 2) which automatically pilots the boat 1 to a desired berthing space 6. In the case shown in FIG. 1, the automatic berthing system 10 automatically pilots the boat 1 to one of the vacant berthing spaces 5. For this purpose, the automatic berthing system 10 is required to identify the berthing spaces 4, 5, allow the operator to make a choice of the desired berthing space 6 from the identified berthing spaces 4, 5, and automatically pilot the boat 1 to the selected berthing space 6 while avoiding obstacles such as breakwater 3, poles 7 and the structure of the pier 2 itself.

Figure 2:
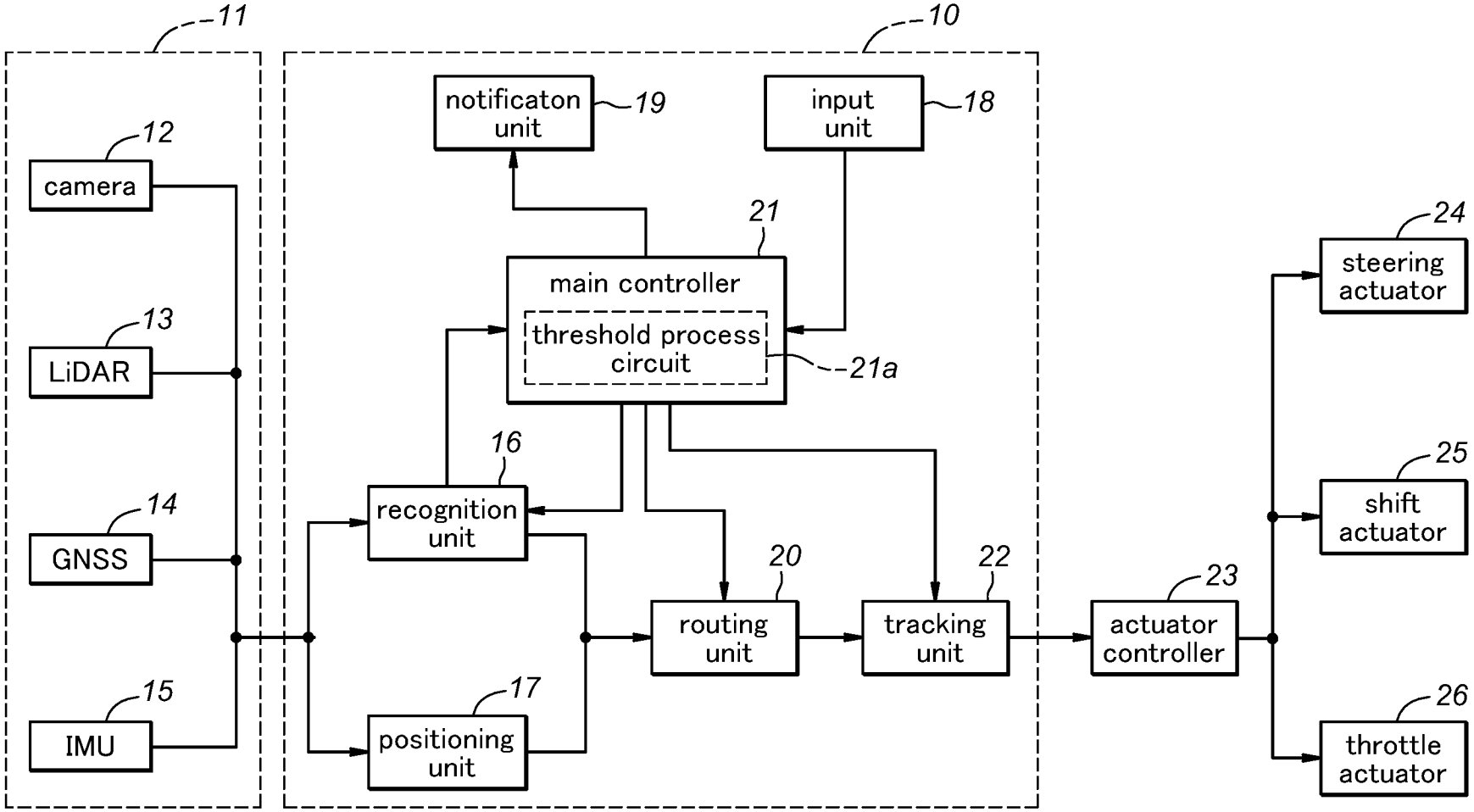
FIG. 2 is a block diagram of an automatic berthing system incorporated with the environment recognition system according to an embodiment of the present invention.

The automatic berthing system 10 shown in FIG. 2 essentially consists of a computer including an electronic processor, memory, a storage system and an interface. The automatic berthing system 10 is configured to communicate with a sensor system 11 which may include a visible light camera 12, a lidar 13 using a laser beam (of visible light, infrared light or ultraviolet light) for detecting external objects, a global navigation satellite system 14 that allows the global positioning of the boat 1 and an inertial measurement unit 15 that detects the accelerations and orientation of the boat 1 along six axes. The lidar 13 includes a transmitter that emits and scans a laser beam in prescribed directions and a receiver that receives the laser beam reflected by external objects and generates a detection signal indicating the distance to each object according to the laser beam reflected thereby. Alternatively or additionally, a millimeter radar may be fitted to the boat 1 to function similarly as the lidar 13.

The output of the sensor system 11 is forwarded to a positioning unit 17 of the automatic berthing system 10 which is provided with a local grid map in which the position of the own boat 1 is identified. The output of the sensor system 11 is also forwarded to a recognition unit 16 of the automatic berthing system 10 which detects various objects surrounding the own boat 1 and identifies available berthing spaces 5 among the detected objects. A map containing the detected objects including the available berthing spaces 5 is thus created by the recognition unit 16, and this data is forwarded to a main controller 21 of the automatic berthing system 10.

The main controller 21 forwards this data to a notification unit 19 of the automatic berthing system 10 which displays this data on a display unit. The display unit may consist of a touch panel which doubles as an input unit 18. The operator is enabled to see a map of the marina M indicating the berthing spaces 4, 5 therein, and marking the available berthing spaces 5 differently from the occupied berthing spaces 4. The operator then chooses one of the available berthing spaces 5 from the input unit 18 as a target berthing space 6. Thus, the input unit 18 serves as a target spot setting unit for setting a target spot to which the boat 1 should be navigated.

Information regarding the selected berthing space 6 is then forwarded to the main controller 21 which communicates this information to the recognition unit 16. The recognition unit 16 then marks the selected berthing space 6 in the grid map obtained from the positioning unit 17 and forwards this data to a routing unit 20. The main controller 21 also commands the routing unit 20 to create the route to the selected berthing space 6 on the grid map forwarded from the recognition unit 16 and the positioning unit 17.

The route created by the routing unit 20 and marked on the grid map is forwarded to a tracking unit 22 which translates the route to the selected berthing space 6 into the piloting data of the boat 1 (such as the scheduling of the speed and the steering angle of the boat 1) and forwards this data to an actuator controller 23. The actuator controller 23 then commands a steering actuator 24 for actuating the steering device of the boat 1, shift actuator 25 for actuating a shifting mechanism of the boat 1 and throttle actuator 26 for actuating a throttle valve of the boat 1 according to this schedule. As a result, the boat 1 is piloted to the selected berthing space 6 while avoiding obstacles (such as the breakwater 3, poles 7 and the structure of the pier 2). More specifically, the main controller 21 sets the current position as a start position, and identifies obstacles that are situated between the current position of the boat 1 and a target spot according to the acquired obstacle information. The main controller 21 then computes a plurality of routes that lead from the current position to the target spot and avoid the obstacles. From these routes, an optimum route is selected which is shortest to the target spot, and contains no curved path having a radius of curvature smaller than the minimum turning radius of the boat 1. In this case, the map data that is required to autopilot the boat 1 can be obtained from the point cloud data acquired by the lidar 13 based on the SLAM (Simultaneous Localization and Mapping) technology. Thereby, the main controller 21 can constantly identify the position of the boat 1 on the map. In this process, the map data obtained from the GNSS system 14 may be additionally utilized.

For the recognition unit 16 to be able to identify the available berthing spaces 5 and cause the routing unit 20 to successfully create a route to the selected berthing space 6, it is necessary to capture the point cloud data of the surrounding objects in an accurate manner. In this regard, it is important to properly process the data from the camera 12 and lidar 13. Alternatively or additionally, a radar using millimeter radio wave may also be used for capturing the point cloud data of the surrounding objects or recognizing the environment surrounding the boat 1. The data obtained from the camera 12 and lidar 13 inevitably contain noises. In either case, it is therefore necessary to eliminate noises from the data by using a suitable noise cutting technology. For this purpose, in the present embodiment, the main controller 21 is provided with a threshold process circuit 21*a* that cuts or eliminates signal components of lower levels than a prescribed threshold value. The threshold process circuit 21*a* may consist of an analog circuit, but when the main controller 21 is composed of a digital processor or a CPU, may also be implemented by a program that digitally executes a threshold process. In this case, if the data is subjected to an excessive noise cutting or filtering, the resolution of the data may be impaired to such an extent as to prevent accurate piloting of the boat 1. In this embodiment, the threshold process circuit 21*a* is implemented by the processor that executes software to realize the automatic berthing system 10, but may also be implemented as a physical circuit or a separate processor that provides an equivalent function by executing software.

The noise cutting technology as used in this disclosure means elimination of parts of point cloud data signals indicating light intensity levels obtained by the lidar 13 which are lower in level than a prescribed threshold value. The intensity levels of the signal obtained from noises signals obtained from objects which are not genuine obstacles) such as waves and water splashes are lower than the intensity levels of the signal obtained from genuine obstacles such as structures, breakwaters and other watercraft. Therefore, by removing the part of the signal which is lower in level than the prescribed threshold, the influences from the noises can be eliminated, and only the genuine obstacles can be detected.

Figure 3:
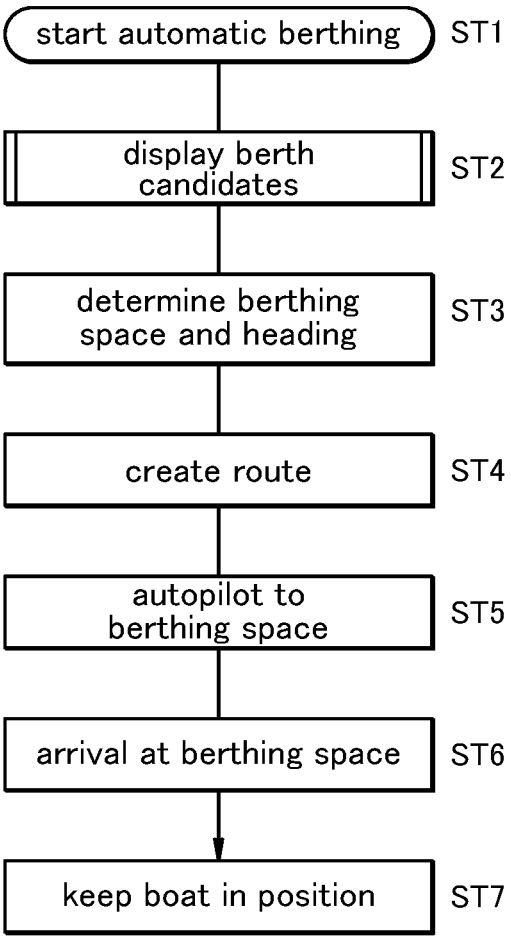
FIG. 3 is a flowchart of an automatic berthing process.

FIG. 3 shows a flowchart of an automatic berthing system 10 according to an embodiment of the present invention. When the boat 1 is approaching a pier 2, the operator activates the automatic berthing system 10 in step ST1. The automatic berthing system 10 then displays the candidates of the berthing space 5 for the boat 1 in step ST2.

Figure 4:
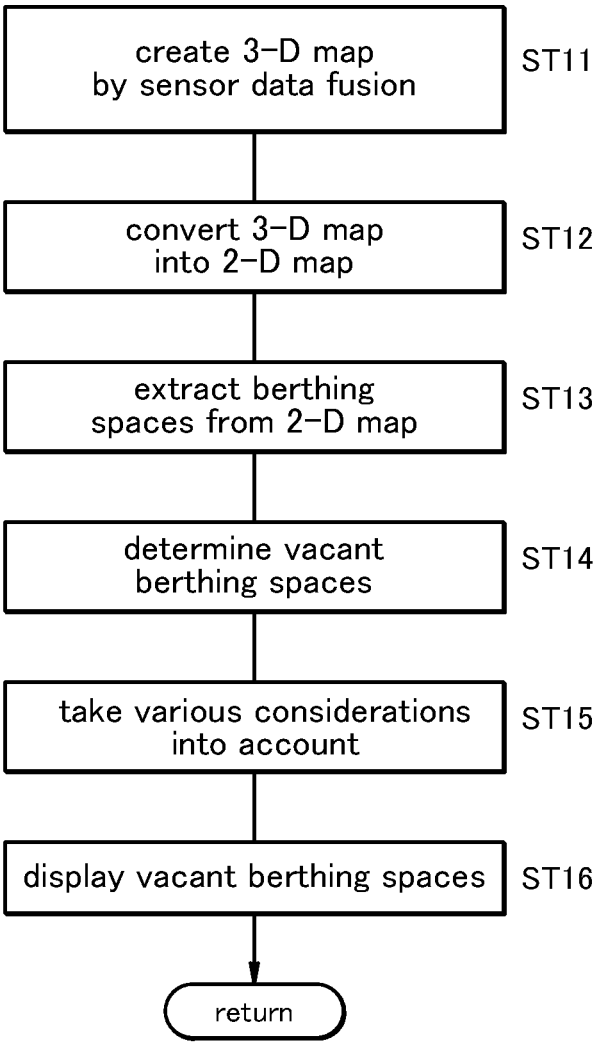
FIG. 4 is a flowchart of a process for identifying and displaying a vacant berthing space.

In step ST2, the automatic berthing system 10 executes the control flow shown in FIG. 4. In this control flow, the recognition unit 16 creates a 3-D map of the environment surrounding the boat 1 by combining the data acquired by the visible light camera 12 (data fusion), the lidar 13, the global navigation satellite system 14 and the inertial measurement unit 15 of the sensor system 11 (ST11), and then converts the 3-D map into a 2-D map (ST12). The 2-D map is displayed on the display screen included in the notification unit 19. The main controller 21 then extracts berthing spaces 4, 5 from the 2-D map and indicates the extracted berthing spaces 4, 5 on the display screen (step ST13). At this time, the berthing spaces 4 that are not occupied are marked accordingly to distinguish them from the occupied ones (step ST14). Alternatively, only the unoccupied berthing spaces 5 may be displayed on the display screen. The unoccupied berthing spaces 5 may vary in size, and mooring fees may vary depending on the size, for instance. Such considerations may be made in choosing the available berthing spaces 5 (ST15). The available berthing spaces 5 are then displayed on the display screen (ST16), and the program flow returns to the main flow shown in FIG. 3.

Once the available berthing spaces 5 are displayed on the display screen, the operator selects one of the available berthing spaces 5, as well as the heading of the boat 1 at the selected berthing space 6 in step ST3. Based on this information supplied by the recognition unit 16 and the main controller 21, the routing unit 20 creates a route to the selected berthing space 6 in step ST14 and forwards a command to the actuator controller 23 to cause the boat 1 to navigate to the selected berthing space 6 by appropriate operation of the steering actuator 24, shift actuator 25 and throttle actuator 26 so as to autopilot the boat 1.

Once the boat 1 arrives at the selected berthing space 6 in step ST6, the tracking unit 22 commands the actuator controller 23 to maintain the boat 1 at the berthing space 6 so as to keep the boat 1 in position in step ST7.

Figure 5:
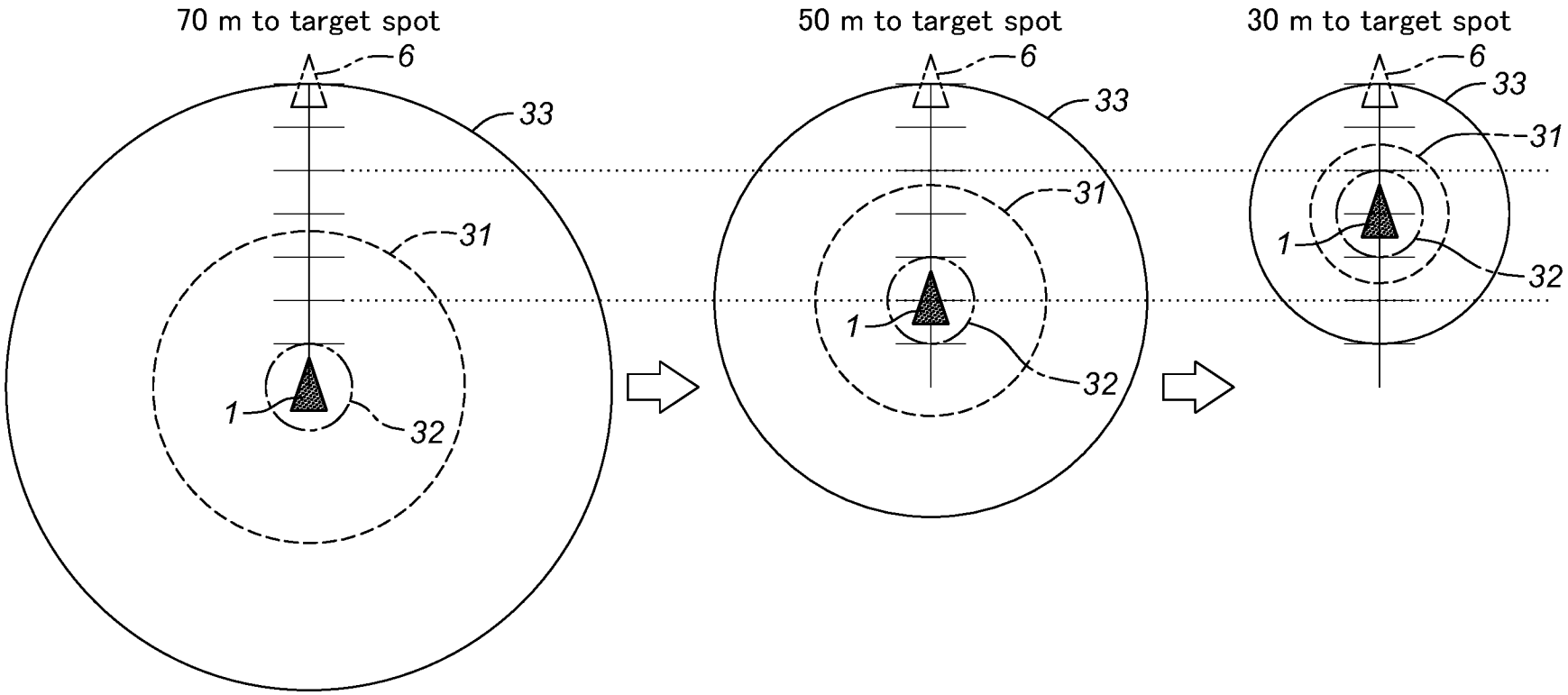
FIG. 5 is a diagram illustrating how regions with different noise cutting levels change as the boat approaches a selected berthing space.
Figure 6:
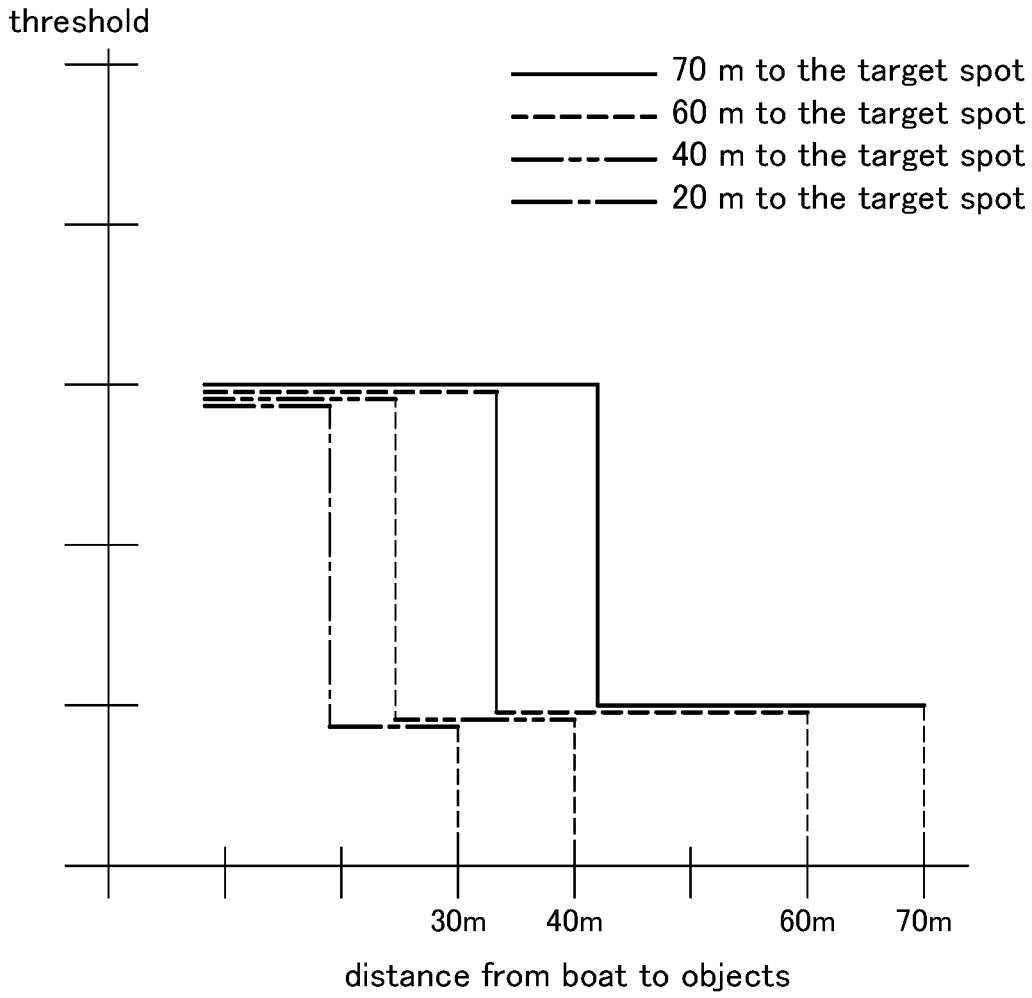
FIG. 6 is a graph showing how regions with different noise cutting levels change as the boat approaches a selected berthing space.

FIGS. 5 and 6 show the different noise cutting degrees (differences in the threshold level) depending on the distance from the boat 1. The point cloud data of an area immediately surrounding the boat 1 contains a large amount of noise due to the waves and ripples of the water surrounding the boat 1 and the splashes created by the boat 1. Therefore, the point cloud data of objects near the boat 1 is subjected to a strong noise-cut (a higher or greater threshold) as compared to the point cloud data of objects located further away from the boat 1. More specifically, the point cloud data of objects within a first distance from the boat 1 (as indicated by the circle denoted with numeral 31) is subjected to a strong noise-cut while the point cloud data of objects beyond the first distance from the boat 1 and up to the target spot (berthing space 6) is subjected to a strong noise-cut or no noise-cut. Further, the first distance may decrease continuously as the boat 1 approaches the destination. The circle denoted with numeral 33 indicates the distance from the boat 1 to the target spot.

Optionally, a region immediately around the boat 1, for instance 5 m radius around the boat 1 (within a second distance from the boat 1) as indicated by the circle denoted with numeral 32 may be designated as a constantly noise-cut region where the point cloud data of the objects in this region is more strongly noise-cut without regard to the distance from the boat 1 to the destination. This region may be canceled when the boat 1 comes within a certain short distance from the destination, for instance 10 m.

In the example shown in FIGS. 5 and 6, the degree of noise-cutting changes at about 40% of the distance between the boat 1 to the target spot as measured from the boat 1 (first distance) changes in a stepwise manner. Suppose that the auto berthing operation starts when the boat 1 is 70 m away from the destination. At this time, the point cloud data of objects 28 m or less away from the boat 1 (42 m or more away from the destination) is strongly noise-cut while the point cloud data of objects more than 28 m away from the boat 1 is weakly noise-cut or not noise-cut. As the boat 1 comes to a point 60 m away from the destination, the point cloud data of objects 24 m or less away from the boat 1 (36 m or more away from the destination) is strongly noise-cut while the point cloud data of objects more than 24 m away from the boat 1 is weakly noise-cut or not noise-cut. As the boat 1 comes to a point 40 m away from the destination, the point cloud data of objects 16 m or less away from the boat 1 (24 m or more away from the destination) is strongly noise-cut while the point cloud data of objects more than 16 m away from the boat 1 is weakly noise-cut or not noise-cut. As the boat 1 comes to a point 30 m away from the destination, the point cloud data of objects 12 m or less away from the boat 1 (18 m or more away from the destination) is strongly noise-cut while the point cloud data of objects more than 12 m away from the boat 1 is weakly noise-cut or not noise-cut.

Figure 7:
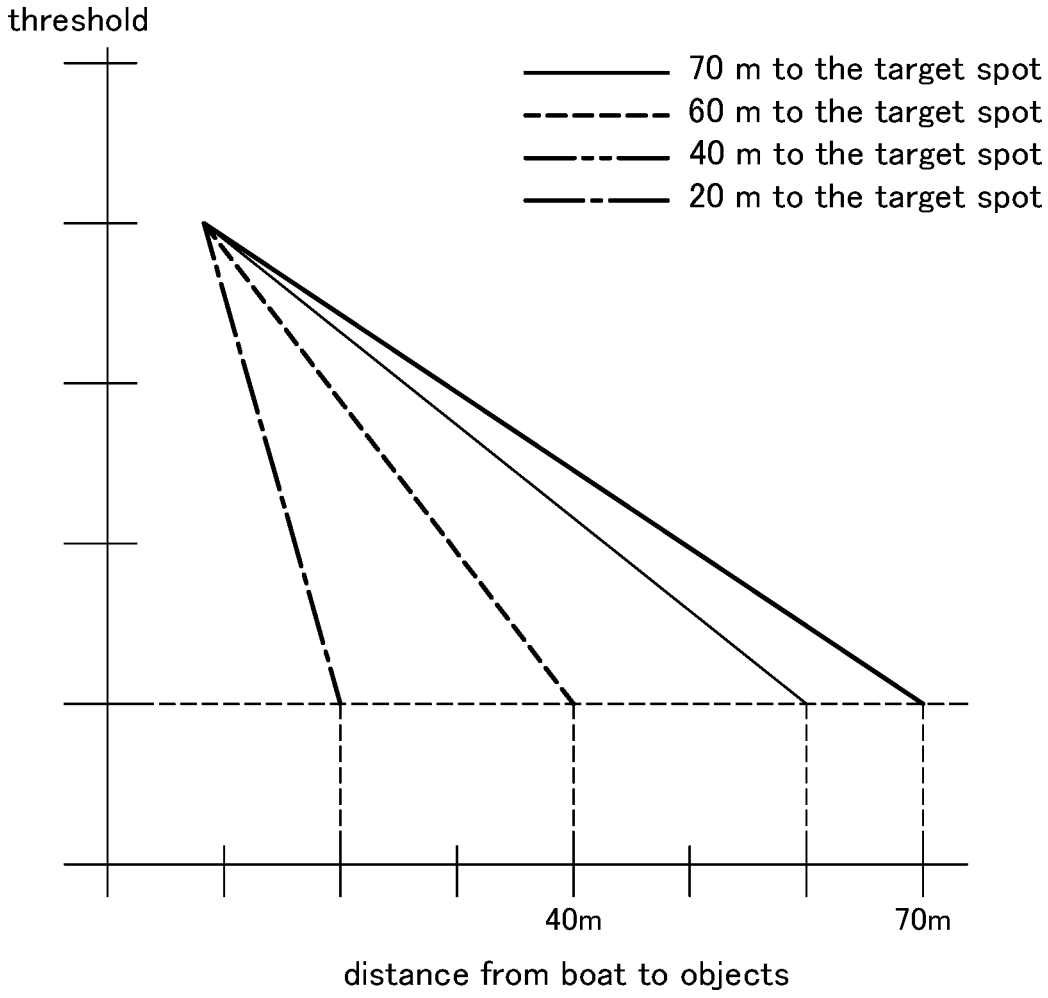
FIG. 7 is a graph similar to that of FIG. 6 according to a modified embodiment of the present invention.

Alternatively, the degree of noise-cutting may change linearly or otherwise in a continuous manner. In the example shown in FIG. 7, the degree of noise-cutting increases linearly such that the degree of noise-cutting increases as the distance to the objects decreases. In other words, the nearer the objects are, the stronger the noise-cutting of the point cloud data thereof becomes.

Figure 8:
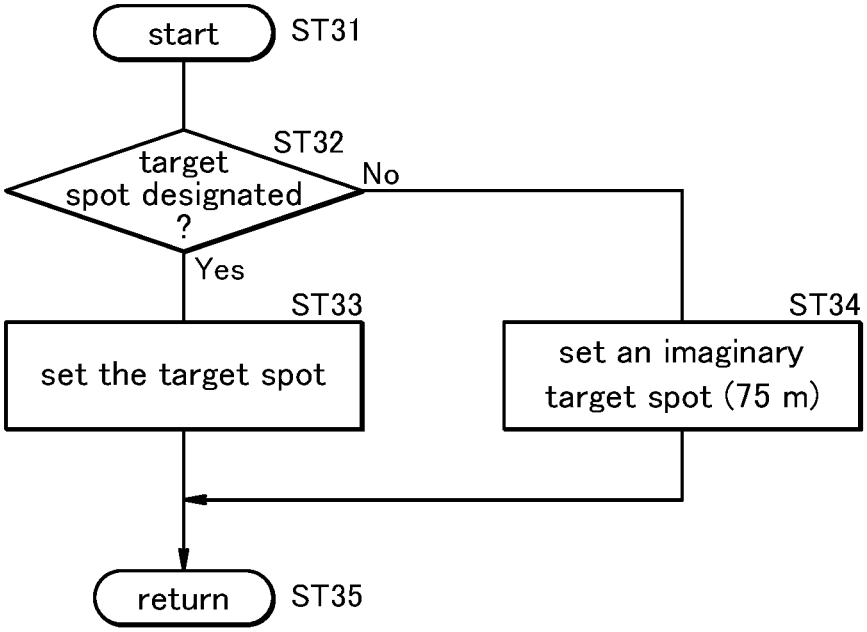
FIG. 8 is a flowchart showing the process of designating a target spot for the environment recognition system.

FIG. 8 shows the process of setting a target spot. When the process flow starts (step ST31), the system determines if a target spot is designated in step ST32. If a target spot is designated, the noise-cutting of the point cloud data of objects is performed based on the distance from the boat 1 to the designated target spot in step ST33. The target spot may be designated manually or as a part of the automatic berthing process. In the latter case, the vacant berthing spot will be designated as the target spot. If no target spot is designated in step ST32, the system assigns a prescribed distance such as 75 m as an imaginary target spot and the noise-cutting of the point cloud data of objects is performed based on the distance from the boat 1 to the imaginary target spot in step ST34. In either case, upon completion of this process, the process flow returns to the main flow (step ST35).

Figure 9:
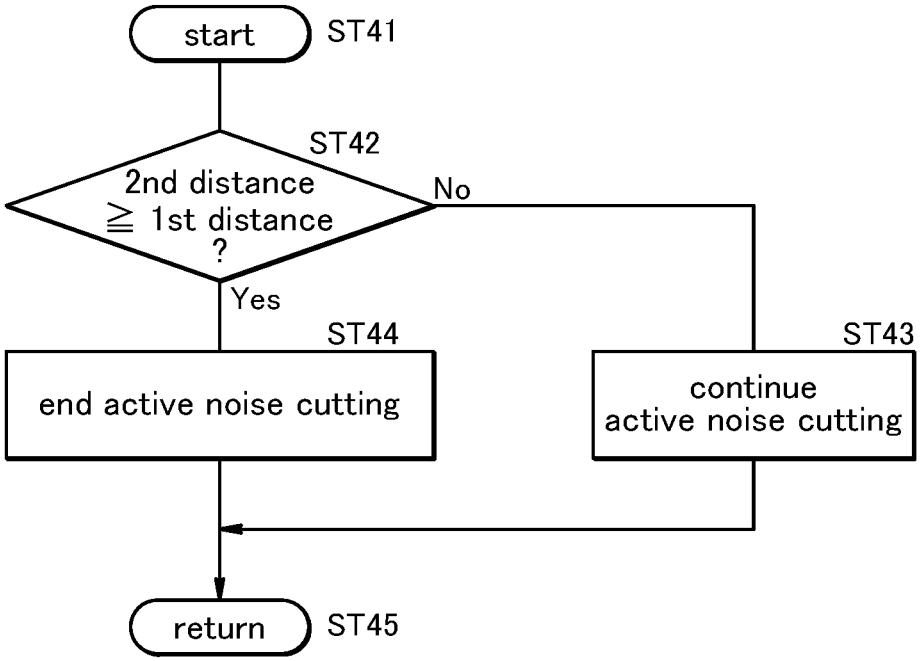
FIG. 9 is a flowchart showing the process of changing the regions with different noise cutting levels as the boat approaches a selected berthing space according to another modified embodiment of the present invention.

In the illustrated embodiment, when the boat 1 approaches the target spot, and the first distance becomes equal to the second distance, the even stronger noise-cutting action at the second distance or less from the environment recognition system takes over the stronger noise-cutting action at the first distance or less from the environment recognition system. The control flow shown in FIG. 9 illustrates this process, upon startup of this control flow (step ST41), it is determined if the first distance is equal to or smaller than the second distance (step ST42). If the first distance is greater than the second distance (No in step ST42), an active noise-cutting (in which the point cloud data of objects within the first distance is strongly noise-cut and the point cloud data of objects within the second distance is even more strongly noise-cut, and the first distance decreases with a decrease in the distance from the boat 1 to the target spot) is maintained (step ST43). If the first distance is equal to or smaller than the first distance (Yes in step ST42), the active noise-cutting is discontinued, and the strong noise-cutting for objects within the first distance is taken over by the even stronger noise-cutting for objects within the second distance (step ST44). Since the second distance is a fixed value, the region of strong noise-cutting around the boat 1 becomes fixed in size. Optionally, when the boat 1 arrives near the target spot (for instance by the distance of 10 m), the noise-cutting of the point cloud data of the surrounding objects may be discontinued.

Figure 10:
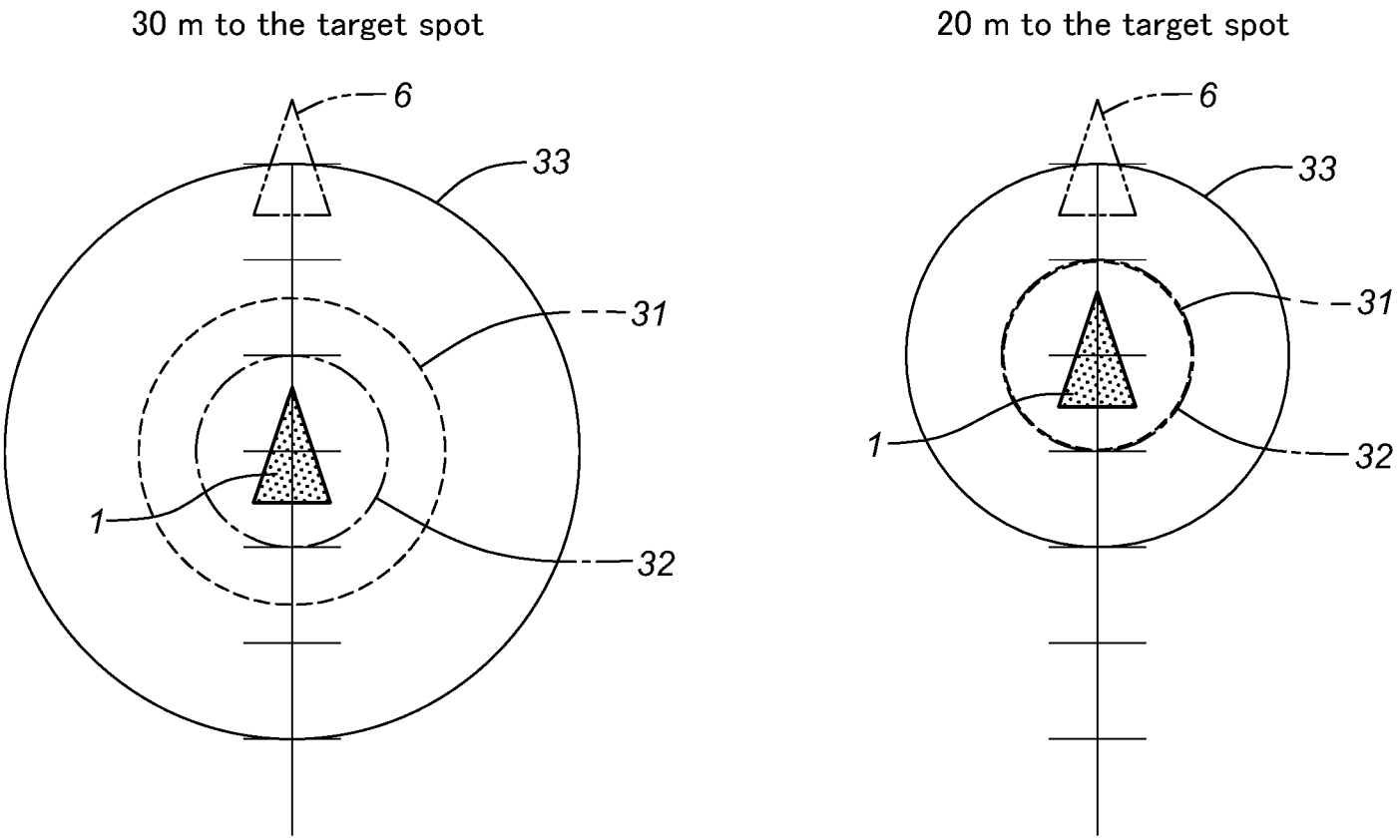
FIG. 10 is a diagram similar to FIG. 5 showing how regions with different noise cutting levels change as the boat approaches a selected berthing space by executing the process shown in FIG. 9.

FIG. 10 illustrates this process of the variable region of strong noise-cutting being taken over by the fixed region of even stronger noise-cutting. In the foregoing embodiment, no consideration is made as to the height in the region that is to be covered by the environment recognition. However, it is possible to make a certain height region as an object of noise cutting. For instance, in view of the fact that the region immediately adjacent to the water surface is most heavily contaminated by noises, it is possible to eliminate a certain region existing immediately about the water surface from the recognition result or from the objects for recognition. If the waterline of the boat 1 and the mounting height of the lidar 13 on the boat 1 are known, it is possible to filter out a region extending from the water surface to a certain height therefrom.

The embodiment described above thus provides an environment recognition system, comprising: an environment recognition device (the lidar 13) that is configured to transmit electromagnetic wave in a predetermined direction to generate a detection signal corresponding to objects existing in an environment; and a main controller 21 that generates a recognition signal corresponding to the detection signal, wherein the main controller 21 is provided with a variable noise cutting circuit for the detection signal, and configured to change a property of the noise cutting circuit according to a distance to each object to be detected. According to this aspect, by applying a variable noise cutting process to the point cloud data obtained from the detection signal so as to attenuate noise components of the point cloud data, various noises in the recognized environment can be reduced. In particular, by suitably selecting the property of the noise cutting circuit according to the distance to each object to be detected, each targeted object can be detected and recognized in an optimum fashion.

The noise cutting circuit includes a threshold process circuit 21*a* which is configured to apply a stronger noise cutting action to the point cloud data by increasing a threshold level of the threshold process circuit 21*a*. By increasing the threshold level of the threshold circuit, low-level components of the point cloud data can be removed so that a favorable noise elimination can be accomplished.

In this environment recognition system, preferably, the noise cutting circuit applies a stronger noise cutting action to the detection signal in regard to an object near the environment recognition system than to an object remote from the environment recognition system. Typically, objects near the environment recognition system are more heavily contaminated with noises than objects in the distance so that by strongly noise-cutting the point cloud data of the objects near the environment recognition system, overall capability to recognize various objects can be improved.

In this environment recognition system, preferably, the noise cutting action becomes stronger continuously as a distance to each object to be detected decreases. Thereby, an abrupt change in the noise cutting action depending on the distances to the objects can be avoided.

In this environment recognition system, preferably, the noise cutting action becomes stronger in a stepwise manner as a distance to each object to be detected decreases. Thereby, the system structure can be simplified.

In this environment recognition system, preferably, the main controller 21 further comprises a target spot setting unit for setting a target, and is configured to generate the recognition signal for objects existing in a region located between the environment recognition system and a target spot designated by the target spot setting unit. By setting a target spot, the environment recognition system can operate in a more defined manner.

In this environment recognition system, preferably, the noise cutting action is stronger for objects to be detected located at a first distance or less from the environment recognition system than for objects to be detected located beyond the first distance and up to the target spot, the first distance progressively decreasing as a distance from the environment recognition system to the target spot decreases. Thus, as the environment recognition system moves toward the target spot, the region where the noise cutting is strong diminishes. Thereby, the environment recognition system is enabled to recognize objects more clearly without being hampered by noises.

In this environment recognition system, preferably, the noise cutting action is even stronger for objects to be detected located at a second distance or less from the environment recognition system than for objects to be detected located beyond the second distance, the second distance being a fixed value smaller than the first distance when the environment recognition system is at a distance from the target spot substantially greater than the first distance. Thereby, noise reduction can be achieved in an even more favorable manner.

In this environment recognition system, preferably, when the first distance becomes equal to the second distance, the even stronger noise cutting action at the second distance or less from the environment recognition system takes over the strong noise cutting action at the first distance or less from the environment recognition system. Thereby, a favorable noise reduction can be achieved in a seamless manner as the environment recognition system approaches the target spot.

The present invention further provides an automatic berthing system 10 for watercraft, comprising: the environment recognition system defined above, and an actuator controller 23 that controls a propulsion device and a steering device of the watercraft, wherein the main controller 21 further includes a notification unit 19 for designating at least one candidate for a target berthing space 6 and an input unit 18 for selecting the target berthing space 6, and is configured to control the actuator controller 23 so as to navigate the watercraft to the target berthing space 6 according to the environment recognition signal generated by the main controller 21. Thereby, a favorable automatic berthing can be achieved without being hampered by noises in the environment recognition signal.

In this automatic berthing system 10 for watercraft, preferably, the main controller 21 is configured to designate a plurality of candidates for the target berthing space 6, and the environment recognition system is configured to set the target spot given as an average of coordinates of the candidates of the target berthing space 6. Thereby, even when there are a plurality of candidates for the target berthing space 6, a favorable automatic berthing operation can be performed.

The present invention thus provides an environment recognition system that allows surrounding objects to be detected in a reliable manner without being hampered by external noises, and an automatic berthing system 10 that allows watercraft to navigate to a selected berthing space 6 in a reliable manner.

The present invention has been described in terms of a preferred embodiment, but is not limited by the embodiment described above, and can be modified in various ways without departing from the scope of the present invention. For example, in the foregoing embodiment a threshold value is set for the point cloud data signal to eliminate noises from the point cloud data of the environment acquired by an environment recognition system and the part of the signal lower in level than a prescribed threshold is removed, but other noise cutting technology may also be used. For instance, a filter such as a low-pass filter may be applied to the signal to remove a high space frequency component therefrom. By lowering and raising the cut-off frequency of the filter or increasing and decreasing the attenuation factor of the high frequency component, the level of noise cutting may be changed in a similar manner. The watercraft with which the present invention can be implemented is not limited to a boat, but may also include other forms of watercraft such as pontoon boats, V-hull watercraft, and jet ski watercraft. Further, the present invention may also be applied to autonomous land vehicles such as autonomous cars and autonomous carts.

In addition, the specific configurations, arrangements, quantities, materials, etc. of various parts can be changed as appropriate within the scope of the present invention. Moreover, the above embodiments may be combined with each other in part or all of the configurations. Further, not all of the components shown in the above embodiments are essential and can be selected and substituted as appropriate.

The invention claimed is:

1. An environment recognition system for watercraft, comprising:

an environment recognition device that includes a transmitter configured to emit a laser beam in a prescribed direction and a receiver configured to receive the laser beam reflected by an external object, the environment recognition device configured to acquire point cloud data and generate a detection signal indicating a distance to the object according to the received laser beam; and a main controller that generates a recognition signal corresponding to the detection signal, wherein the main controller is provided with a variable noise cutting circuit for the detection signal, and configured to be forwarded information regarding a target spot of the watercraft, set a first distance from the environment recognition system according to a distance from the environment recognition system to the target spot, set a threshold value regarding intensity of the received laser beam, set the threshold value higher for the object within the first distance than the object beyond the first distance, eliminate a signal indicating the intensity of the received laser beam lower than the threshold value and identify a position of the watercraft on a map, and decrease the first distance as the distance from the environment recognition system to the target spot decreases.

2. The environment recognition system according to claim 1, wherein the noise cutting circuit includes a threshold process circuit which is configured to apply a stronger noise cutting action to the detection signal by increasing a threshold level of the threshold process circuit.

3. The environment recognition system according to claim 1, wherein a noise cutting action of the noise cutting circuit becomes stronger continuously as a distance to each object to be detected decreases.

4. The environment recognition system according to claim 1, wherein a noise cutting action of the noise cutting circuit becomes stronger in a stepwise manner as a distance to each object to be detected decreases.

5. The environment recognition system according to claim 1, wherein the main controller further comprises a target spot setting unit, and is configured to generate the recognition signal for objects existing in a region located between the environment recognition system and the target spot designated by the target spot setting unit.

6. The environment recognition system according to claim 5, wherein a noise cutting action of the noise cutting circuit is stronger for objects to be detected located at the first distance or less from the environment recognition system than for objects to be detected located beyond the first distance and up to the target spot.

7. The environment recognition system according to claim 6, wherein the noise cutting action is even stronger for objects to be detected located at a second distance or less from the environment recognition system than for objects to be detected located beyond the second distance, the second distance being a fixed value smaller than the first distance when the environment recognition system is at a distance from the target spot greater than the first distance.

8. The environment recognition system according to claim 7, wherein when the first distance becomes equal to the second distance, the noise cutting action at the second distance or less from the environment recognition system takes over the noise cutting action at the first distance or less from the environment recognition system.

9. An automatic berthing system for watercraft, comprising:

the environment recognition system according to claim 5, and an actuator controller that controls a propulsion device and a steering device of the watercraft, wherein the main controller further includes a notification unit for designating at least one candidate for a target berthing space and an input unit for selecting the target berthing space, and is configured to control the actuator controller so as to navigate the watercraft to the target berthing space according to the recognition signal generated by the main controller.

10. The automatic berthing system according to claim 9, wherein the main controller is further configured to designate a plurality of candidates for the target berthing space, and the environment recognition system is configured to set the target spot given as an average of coordinates of the candidates of the target berthing space.

* * * * *